US005100263A

United States Patent [19]

Woodford et al.

[11] Patent Number: 5,100,263

[45] Date of Patent: Mar. 31, 1992

[54] MINE ROOF SUPPORT ASSEMBLY

[75] Inventors: Brian J. Woodford, Pershore; Stephen A. Brown, Cheltenham, both of England

[73] Assignee: Meco Mining Equipment Limited, Tewkesbury, England

[21] Appl. No.: 604,464

[22] Filed: Oct. 29, 1990

[30] Foreign Application Priority Data

Nov. 11, 1989 [GB] United Kingdom ..... 8925547

[51] Int. Cl.[5] ..... E21D 23/04

[52] U.S. Cl. ..... 405/297; 405/299

[58] Field of Search ..... 405/291, 295, 296, 297, 405/299; 299/31, 33

[56] References Cited

U.S. PATENT DOCUMENTS 3,811,288 5/1974 Wehner et al. ..... 405/297 X 4,311,417 1/1982 Bower et al. ..... 405/297

4,600,340 7/1986 Rosenberg ..... 405/297

*Primary Examiner*—David H. Corbin

*Attorney, Agent, or Firm*—Young & Thompson

[57] ABSTRACT

A mine roof support includes a ground engaging base section, a roof engageable canopy, and hydraulic props for raising and lowering the canopy relative to the base section. An advancing mechanism is provided for advancing the roof support towards the mine face, and a base lifting mechanism is provided for raising one end of the roof support prior to advancing the support towards the mine face. The base lifting mechanism includes a lifting ram mounted with respect to the base section for slidable movement between an upper operative position in which the ram can be extended to lift the one end of the roof support clear of the ground and a lower position in which the canopy can assume a position relative to the base section lower than would be possible with the lifting ram in its upper operative position.

6 Claims, 2 Drawing Sheets

MINE ROOF SUPPORT ASSEMBLY

BACKGROUND TO THE INVENTION

This invention relates to a mine roof support assembly, and in particular to a mine roof support assembly which incorporates a base lifting mechanism.

Mine roof supports include a ground engaging base section, a roof engageable canopy and hydraulic prop means for raising and lowering the canopy relative to the base section. It is known to provide these roof supports with an advancing mechanism for advancing the support towards a mine face, and a base lifting mechanism to raise the leading edge of the roof support clear of the ground prior to advancing the support towards the mine face. These base lifting mechanisms include one or more hydraulic rams mounted with respect to the base section of the roof support and suffer from the drawback that the lifting ram or rams restrict the degree to which the canopy can be lowered relative to the base section and, hence, the degree of compactness of the roof support for transportation.

SUMMARY OF THE INVENTION

According to the present invention, there is provided a mine roof support assembly comprising a mine roof support which includes a ground engaging base section, a roof engageable canopy and hydraulic prop means for raising and lowering the canopy relative to the base section, an advancing mechanism for advancing the roof support towards a mine face, and a base lifting mechanism including a lifting ram mounted with respect to the base section for slidable movement between an upper operative position in which the ram can be extended to lift one end of the roof support clear of the ground and a lower position in which the canopy can assume a lower position relative to the base section than would be possible with the lifting ram in its upper operative position.

Preferably, the lifting ram is slidable in a bracket fixed with respect to the base section. In this case, preferably, the ram has means, e.g. a flange, which co-operates with the bracket to define the upper operative position of the ram. Also, preferably, the ram is a friction fit in the bracket so that, as the canopy is lowered towards the base section, the canopy will come into contact with the ram and move the ram towards its lower position.

Conveniently, the base section comprises two parallel spaced apart pontoon members, which are connected together by a rigid bridge piece, and the lifting ram is mounted on the bridge piece. In this case, conveniently, the advancing mechanism comprises a relay bar disposed between the pontoon members and the lifting ram acts between the relay bar and the bridge piece to raise one end of the roof support clear of the ground.

The invention will now be more particularly described, by way of example, with reference to the accompanying drawings.

DESCRIPTION OF THE PREFERRED EMBODIMENTS

Figure 1:
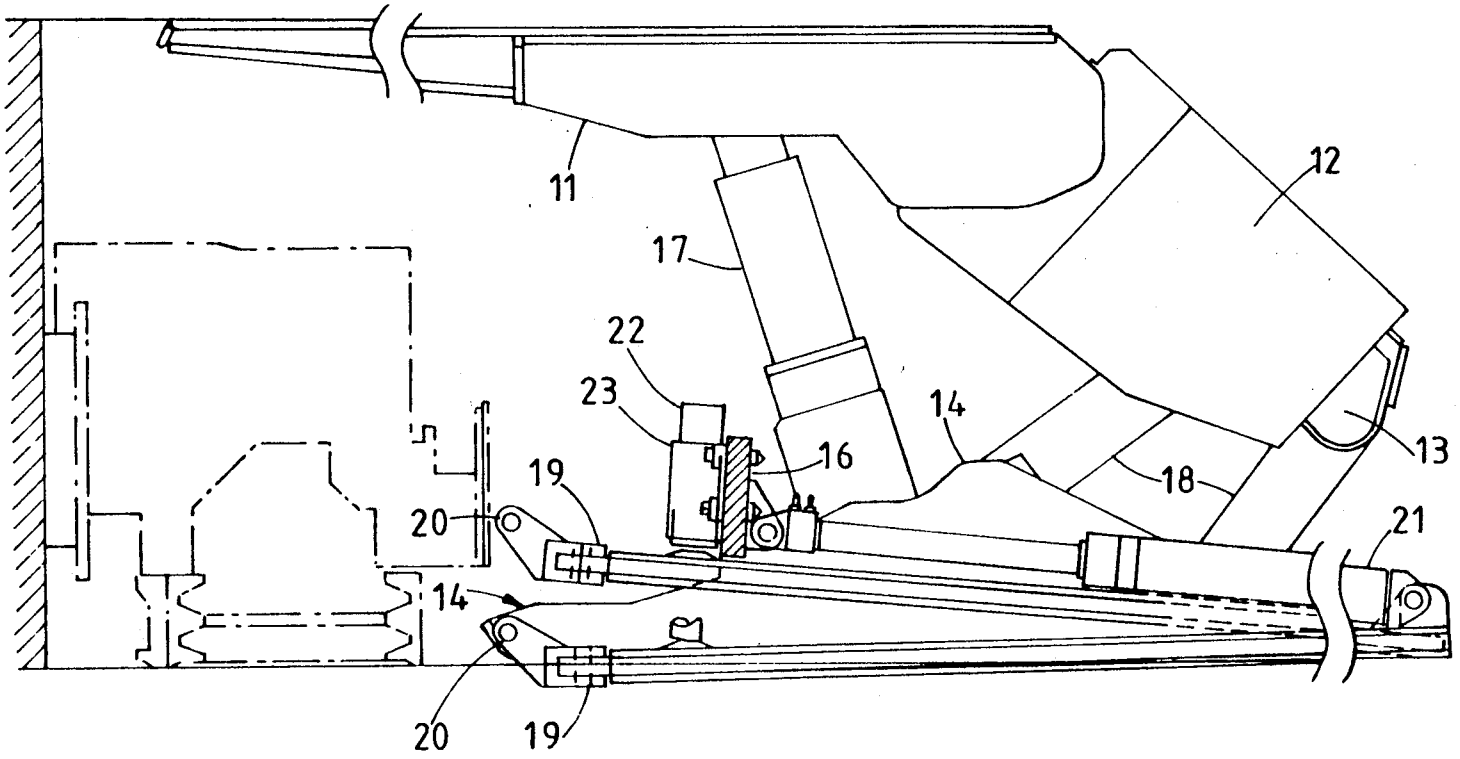
FIG. 1 is a side view of part of a mine roof support assembly according to the invention, showing the lifting ram in an upper operative position.

Referring to the drawings, the mine roof support assembly shown therein includes a roof support comprising a canopy 11, a shield section 12, a lemniscate linkage arrangement 13, a base section 14, and two hydraulic props 17.

The base section comprises two parallel spaced apart pontoon members 15 connected together by a rigid bridge piece 16 adjacent to the leading end of the base section, i.e. that end of the base section which, in use, is nearer to the mine face.

The shield section 12 is pivotally connected at one end to one end of the canopy, and the lemniscate linkage arrangement 13, which includes four links 18, is pivotally connected at one end to the other end of the shield section, and at the other end to the pontoon members 15.

The roof support assembly also includes an advancing mechanism which is disposed in the space between the pontoon members 15, and which comprises a single relay bar 19, a mounting hook 20 connected to one end of the relay bar, and an advancing ram 21 pivotally connected at one end to the other end of the relay bar 19 and pivotally connected at its other end to the bridge piece 16. When the roof support assembly is in use, the relay bar 19 is anchored by connecting the mounting hook 20 to a conveyor.

Figure 2:
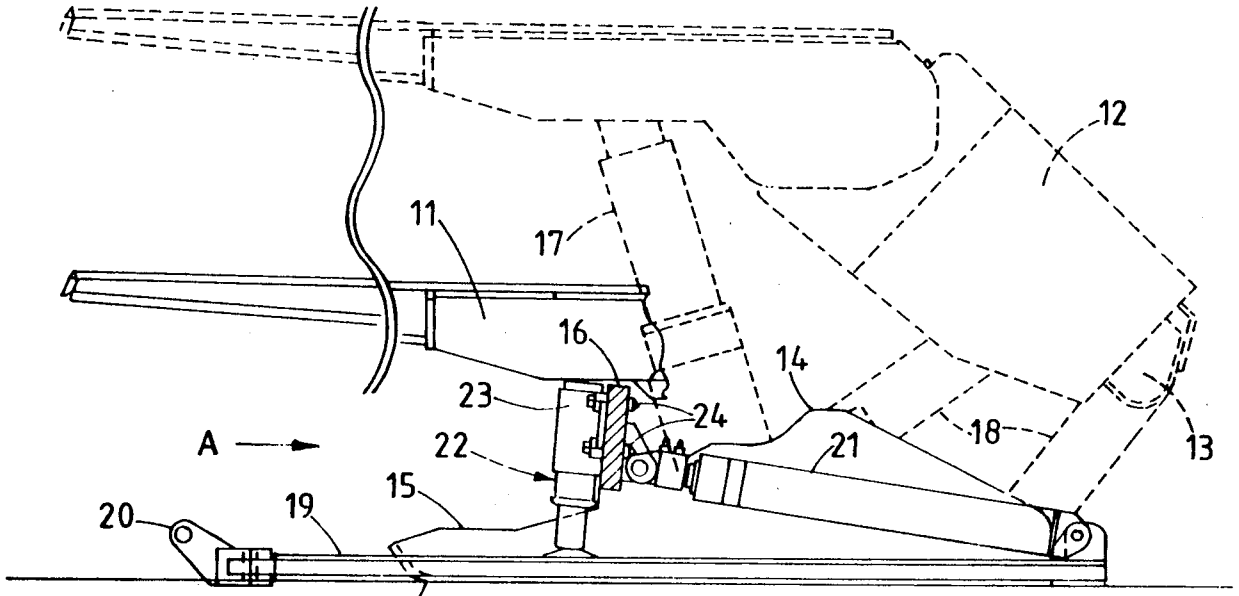
FIG. 2 is a view similar to FIG. 1, but showing the lifting ram in a lower position.
Figure 3:
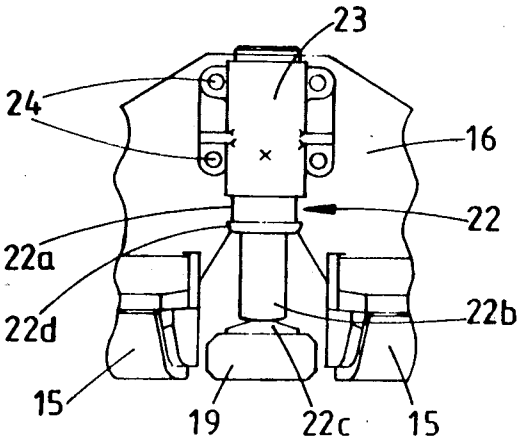
FIG. 3 is a fragmentary view taken in the direction of arrow A of FIG. 2, on an enlarged scale.

The roof support assembly also comprises a base lifting mechanism comprising a lifting ram 22 which is mounted in a bracket 23, which is secured to the bridge piece 16 by bolts 24, for slidable movement between an upper operative position (as shown in FIG. 1) and a lower position (as shown in FIG. 2).

The lifting ram 22 comprises a cylinder **22*a*, a piston rod 22*b*, and a pad 22*c* articulated to an outer end of the piston rod 22*b*. The cylinder 22*a* is a friction fit in the bracket 23 and has at its lower end an annular flange 22*d* which co-operates with the bracket 23 to define the upper operative position of the ram 22. The pad 22*c* bears on the relay bar 19 and, when the roof support assembly is in use, some fluid pressure is maintained on the ram so as to ensure that the pad 22*c* always remains in contact with the relay bar 19**.

The roof support can be advanced towards a mine face in a conventional manner, by first of all raising the leading end of the roof support clear of the mine floor by extending the ram 22 to pivot the base section 14 upwards. Then, with the ram 22 in an extended condition, the advancing ram 21 is extended to push the roof support towards the mine face. The leading end of the roof support is then lowered so that it again makes contact with the mine floor.

In order that the roof support assembly can adapt to a uneven floor of a mine during a support setting operation without damaging or bending the relay bar 19, the relay bar needs to have some freedom of movement in a vertical plane. A typical range of movement of the relay bar can be seen in FIG. 1 which shows the relay bar at opposite ends of its range of movement. When the relay bar 19 is in its upper limit position with the base section 14 in contact with the mine floor, it will be seen that the ram 22 is in a fully retracted condition and the cylinder **22*a* of the ram projects well above the uppermost edge of the bridge piece 16. If the ram 22 were to be fixed in its operative position as shown in FIG. 1, it would restrict the degree to which the canopy 11 can be lowered relative to the base section 14** and, hence. the degree of compactness of the roof support for transportation.

However, with the arrangement described above and with the mounting hook 20 disconnected from the conveyor, the canopy 11 can be lowered to bear on the ram 22 and move the ram 22 towards its lower position (as shown in full lines in FIG. 2) with the result that the roof support assembly can be made more compact for ease of transportation.

When the roof support assembly has been moved to a new location, the ram 22 will be returned to its upper operative position when it is next extended to raise the leading end of the roof support clear of the ground.

The above embodiment is given by way of example and various modifications will be apparent to persons skilled in the art without departing from the scope of the invention. For example, the base lifting mechanism could comprise two lifting rams supported for slidable movement relative to the two pontoon members, respectively, and the ram or rams could act on a lever or levers pivotally connected to the base section or on the mine floor instead of acting on the relay bar as described above.

We claim:

1. A mine roof support assembly comprising a mine roof support which includes a ground engaging base section, a roof engageable canopy and hydraulic prop means for raising and lowering the canopy relative to the base section, an advancing mechanism for advancing the roof support towards the mine face, a base lifting mechanism including a lifting ram, and a bracket for the ram on the base section, the ram being slidable in the bracket under pressure from the canopy between an upper operative position in which the ram can be extended to lift one end of the roof support clear of the ground and a lower position in which the canopy can assume a position relative to the base section lower than would be possible with the lifting ram in its upper operative position.

2. A mine roof support assembly as claimed in claim 1, wherein the ram has means which co-operate with the bracket to define the upper operative position of the ram.

3. A mine roof support assembly as claimed n claim 1, wherein the ram is a friction fit in the bracket so that, as the canopy is lowered towards the base section, the canopy will come into contact with the ram and move the ram towards its lower position.

4. A mine roof support assembly as claimed in claim 1, wherein the base section comprises two parallel spaced apart pontoon members, and a rigid bridge piece connecting the pontoon members together, and wherein the lifting ram is mounted on the bridge piece.

5. A mine roof support assembly as claimed in claim 4, wherein the advancing mechanism comprises a relay bar disposed between the pontoon members and the lifting ram acts between the relay bar and the bridge piece to raise one end of the roof support clear of the ground.

6. A mine roof support assembly as claimed in claim 1, the ram comprising a cylinder slidably disposed in the bracket and a piston rod slidably disposed in the cylinder and extending downwardly from the cylinder, the canopy being engageable with an upper end of the cylinder remote from the piston rod and disposed above the bracket to cause the ram to slide downwardly in the bracket under pressure from the canopy.

* * * * *